United States Patent [19]

Perreault

[11] 4,135,175

[45] Jan. 16, 1979

[54] ELECTRIC FUSE

[75] Inventor: Richard J. Perreault, Amesbury, Mass.

[73] Assignee: Gould Inc., Rolling Meadows, Ill.

[21] Appl. No.: 819,062

[22] Filed: Aug. 4, 1977

[51] Int. Cl.[2] ..... H01H 85/16

[52] U.S. Cl. ..... 337/248; 337/252

[58] Field of Search ..... 337/248, 251, 252, 253, 337/236

[56] References Cited

FOREIGN PATENT DOCUMENTS 1159291 8/1960 France ..... 337/236

*Primary Examiner*—Harold Broome

*Attorney, Agent, or Firm*—Erwin Salzer

[57] ABSTRACT

An electric fuse wherein the ferrules are held to the casing by means of circular grooves in the casing of the fuse engaged by the ferrules, and the ferrules are under the action of elastic forces tending to move the ferrules axially outwardly. The aforementioned elastic forces are produced by the ferrules themselves, or portions thereof.

2 Claims, 2 Drawing Figures

ELECTRIC FUSE

BACKGROUND OF THE INVENTION

One of the prior art method used heretofore to affix ferrules to fuse casings consists in providing the casings with circular grooves, placing more or less resilient inserts into the grooves, and working the axially inner edges of the ferrules into these grooves and into firm engagement with the resilient inserts therein.

A modification of this method consists in interposing relatively elastic elements between the rims of the casing and the end surfaces of the ferrules, and thereafter working the axially inner edges of the ferrules into grooves provided in the casing of the fuse.

Both method have limitations of which the most outstanding resides in the fact that the first method calls for resilient grooves inserts or annuli, and the second method calls for resilient washers, O-rings, or the like.

It is, therefore, one of the primary objects of this invention to provide electric fuses, not requiring any additional parts for stressing the lateral walls of the ferrules, i.e. wherein such stressing is effected by parts of the ferrules themselves.

SUMMARY OF THE INVENTION

Fuses embodying this invention include ferrules having bent, resilient end surfaces resting against the casing of the fuse and tending when stressed to move said ferrules relative to said casing in a longitudinal direction and away from the center region of said casing. Ferrules according to this invention further have clamping means engaging annular grooves in said casing and thereby precluding said pair of ferrules from moving in accordance with the forces exerted by the end surfaces of said pair of ferrules.

DESCRIPTION OF PREFERRED EMBODIMENT

Figure 1:
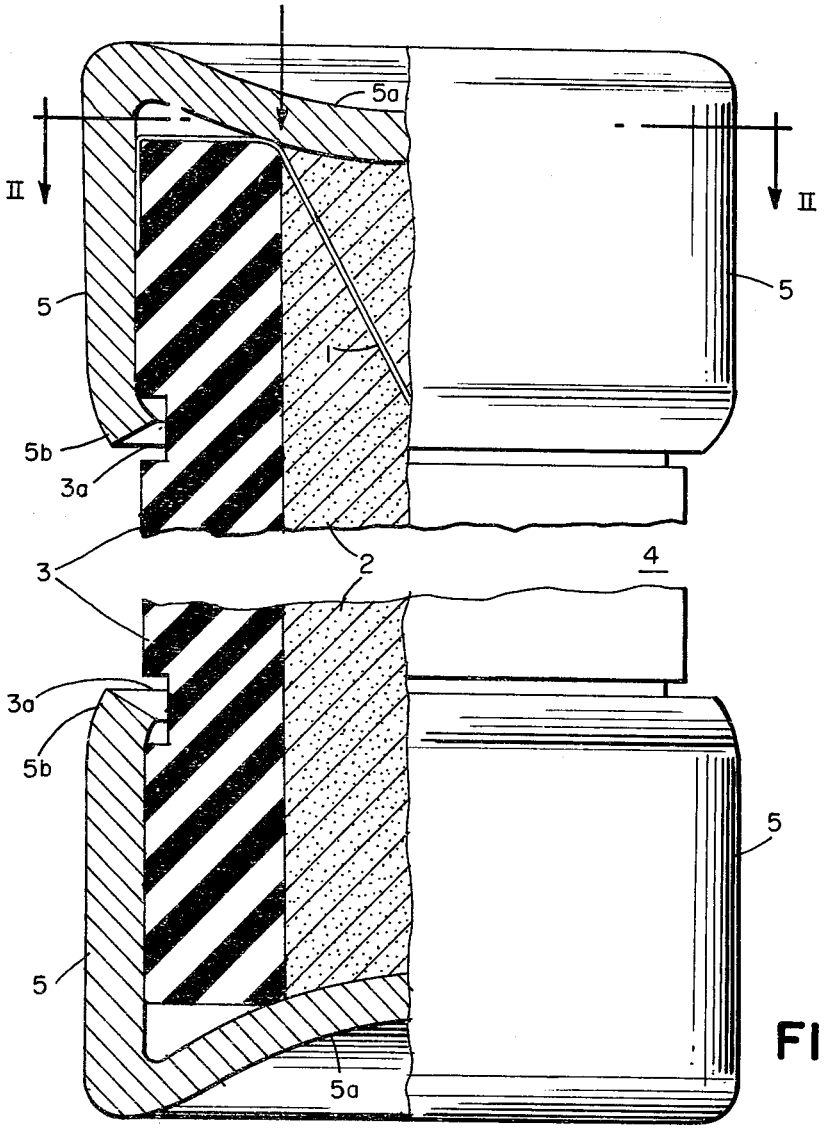
FIG. 1 is partly a longitudinal section of, and partly a front view of, a fuse embodying this invention.
Figure 2:
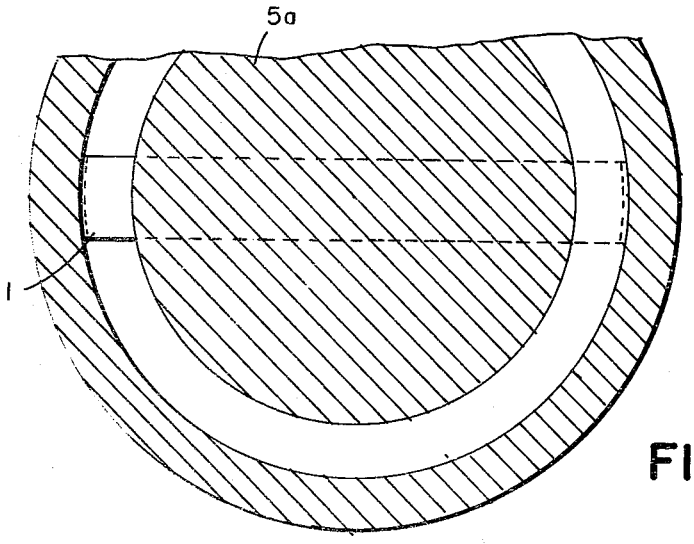
FIG. 2 is a cross-section along II-II of FIG. 1.

Referring now to the drawing, the fusible element 1 is embedded in the pulverulent arc-quenching filler 2, e.g. quartz-sand. The tubular casing 3 consists of an electric insulating material, e.g. alumina, and houses fusible element 1 and filler 2. Casing 3 has a pair of annular grooves 3*a* remote from the center region 4 thereof. A pair of ferrules 5 is mounted on the end of casing 2 and conductively interconnected by fusible element 1. Said pair of ferrules 2 having bent resilient end surfaces 5*a* resting against casing 3 and bending when stressed to move said ferrules relative to the casing 3 in a direction longitudinally and away from the center region thereof.

Ferrules 5 further have clamping means 5*b* formed by their axially inner edges engaging annular grooves 3*a* in said casing 3 and thereby precluding said pair of ferrules 5 from moving in accordance with the forces exerted by the end surfaces 5*a* of said pair of ferrules 5.

As shown in FIG. 1, the end surfaces 5*a* of ferrules 5 are substantially convex which imparts a high degree of resiliency to them. The radially inner portions of end surfaces 5*a* exert a greater pressure upon casing 3 than the radially outer portions thereof. Said pair of ferrules 5 have clamping means 5*b* engaging said annular groove 3*a* in said casing and precluding any movement of said pair of ferrules relative to said casing under the action of said forces exerted by said end surfaces 5*a* of said pair of ferrules 5.

I claim as my invention:

1. An electric fuse including (a) a tubular casing of electric insulating material having a pair of rims at the ends thereof;

(b) a pulverulent arc-quenching filler inside said casing;

(c) a fusible element embedded in said filler and extending diagonally through said casing with the ends thereof extending over said rims to the outside of said casing;

(d) a pair of ferrules mounted on said casing and conductively interconnected by said fusible element, said pair of ferrules having concavely bent resilient end surfaces resting against the ends of said fusible element and tending, when stressed, to move said pair of ferrules relative to said casing in a direction longitudinally thereof and away from the center region thereof; and (e) said casing having a pair of annular grooves forming fixed points receiving the axially inner ends of said pair of ferrules.

2. An electric fuse including (a) a tubular casing of electric insulating material having a pair of rims at the ends thereof;

(b) a fusible element inside said casing having ends bent around said pair of rims to the outside of said casing and having an intermediate portion slanting through the space defined by said casing;

(c) a pulverulent arc-quenching filler inside said casing embedding a portion of said fusible element;

(d) a pair of ferrules mounted on the ends of said casing and conductively interconnected by said fusible element, said pair of ferrules having substantially convex end surfaces imparting resiliency to them so as to be movable relative to said casing due to the resiliency of their end surfaces; and (e) said casing having a pair of annular grooves each forming a fixed point receiving the axially inner end of one of said pair of ferrules.

* * * * *